US011213117B2

(12) United States Patent
Schuster et al.

(10) Patent No.: US 11,213,117 B2
(45) Date of Patent: Jan. 4, 2022

(54) NESTED BRUSH

(71) Applicant: Danco, Inc., Irving, TX (US)

(72) Inventors: Michael J. Schuster, Shorewood, IL (US); Thomas R. Bajek, Naperville, IL (US); Dwayne A. Porter, Lockport, IL (US)

(73) Assignee: DANCO, INC., Irving, TX (US)

( * ) Notice: Subject to any disclaimer, the term of this patent is extended or adjusted under 35 U.S.C. 154(b) by 17 days.

(21) Appl. No.: 15/999,437

(22) Filed: Aug. 20, 2018

(65) Prior Publication Data

US 2019/0059567 A1 Feb. 28, 2019

Related U.S. Application Data

(60) Provisional application No. 62/548,565, filed on Aug. 22, 2017.

(51) Int. Cl.
*A46B 5/00* (2006.01)
*A46B 5/02* (2006.01)

(52) U.S. Cl.
CPC ..... *A46B 5/0095* (2013.01); *A46B 5/0008* (2013.01); *A46B 5/0012* (2013.01); *A46B 5/021* (2013.01); *A46B 2200/3073* (2013.01)

(58) Field of Classification Search
CPC ..... A46B 5/0016; A46B 5/0095; A46B 5/021; A46B 5/0012; A46B 5/0008; A46B 15/00; A46B 5/0004; A46B 5/008; A46B 7/04; A46B 7/042; A47L 1/13; A47L 13/12
USPC ..... 15/106, 160, 159.1, 111, 184, 202; D4/121, 119
See application file for complete search history.

(56) References Cited

U.S. PATENT DOCUMENTS

| | | | | |
|---|---|---|---|---|
| 3,167,799 A * | 2/1965 | Mckinley | A46B 7/04 | 15/176.4 |
| 6,574,822 B1 * | 6/2003 | Osiecki | A46B 7/042 | 15/106 |
| 7,309,087 B2 * | 12/2007 | Lane | E05B 85/10 | 292/216 |
| 2004/0148721 A1 * | 8/2004 | Spaulding | A46B 5/0016 | 15/118 |

* cited by examiner

*Primary Examiner* — Katina N. Henson
(74) *Attorney, Agent, or Firm* — Thomas Horstemeyer, LLP

(57) ABSTRACT

Disclosed are various embodiments of a nested brush. The nested brush can include a first brush and a second brush. The first brush can include a first elongated handle and a first brush head. The first elongated handle can include a first end, a second end, and a brush receptacle extending from the first end of the first elongated handle along a portion of the first elongated handle. The first brush head can be attached to the first end of the first elongated handle. The second brush can include a second elongated handle and a second brush head. The second elongated handle can include a first end and a second end. The second elongated handle can be configured to fit within the brush receptacle of the first elongated handle. The second brush head can be attached to the first end of the second elongated handle.

18 Claims, 16 Drawing Sheets

NESTED BRUSH

CROSS-REFERENCE TO RELATED APPLICATIONS

This application claims priority to, and the benefit of, U.S. Provisional Patent Application No. 62/548,565 entitled "NESTED BRUSH" and filed on Aug. 22, 2017, which is incorporated by reference as if set forth herein its entirety.

BACKGROUND

Washing machines may develop biological films from mold, mildew, and other organisms that thrive in moist environments. For example, the gasket of front-loading washing machines often develops films from mold or mildew due to the accumulation of water and moisture in the grooves of the gasket. Because these grooves often form part of a watertight seal when the door is closed, these grooves are unable to be cleaned or sanitized using specialized washing machine cleaners that can be used during the washing machine's normal cycle.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
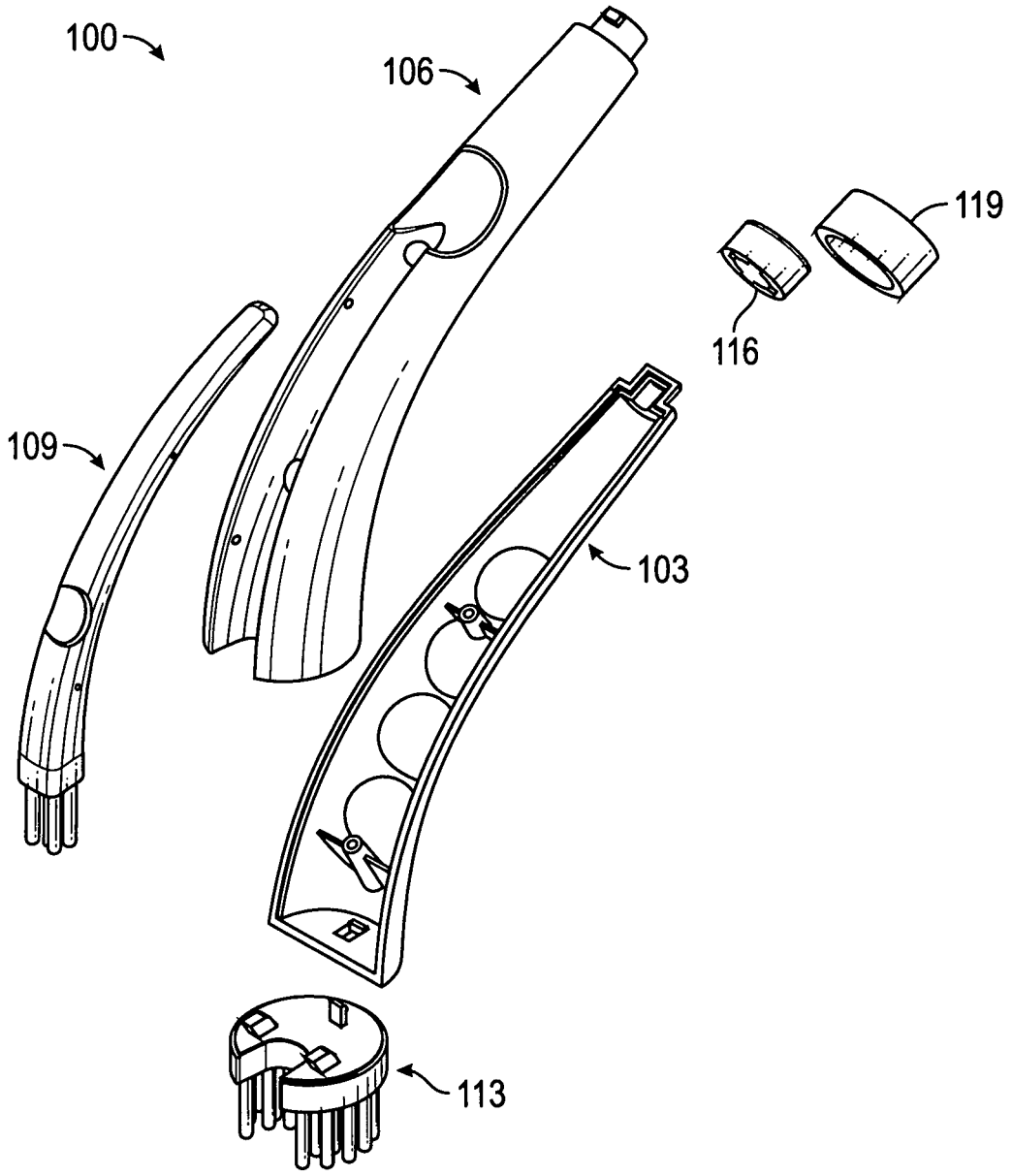
FIG. 1 depicts an exploded view of a nested brush according to various embodiments of the present disclosure.

In the following discussion, a description of an apparatus for cleaning washing machines is provided. With reference to FIG. 1, shown is an exploded view of the components of an apparatus 100 that can be used to clean washing machines. The apparatus 100 can include a first brush, which includes a first elongated portion 103 of a handle and a second elongated portion 106 of the handle, a brush head 113, a sponge cap 116, and a sponge 119. The apparatus 100 can also include a detail brush 109, which includes a second elongated handle and a second brush head. Each of these components will be discussed in further detail in the following figures.

Figure 2A:
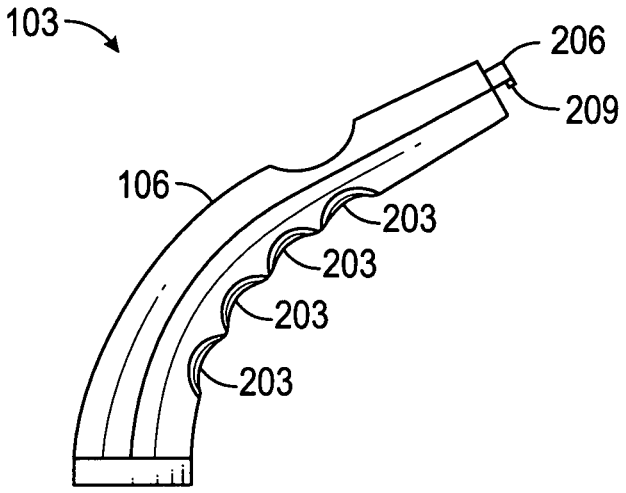
FIGS. 2A-2C are perspective drawings of a component of a nested brush according to various embodiments of the present disclosure.
Figure 2B:
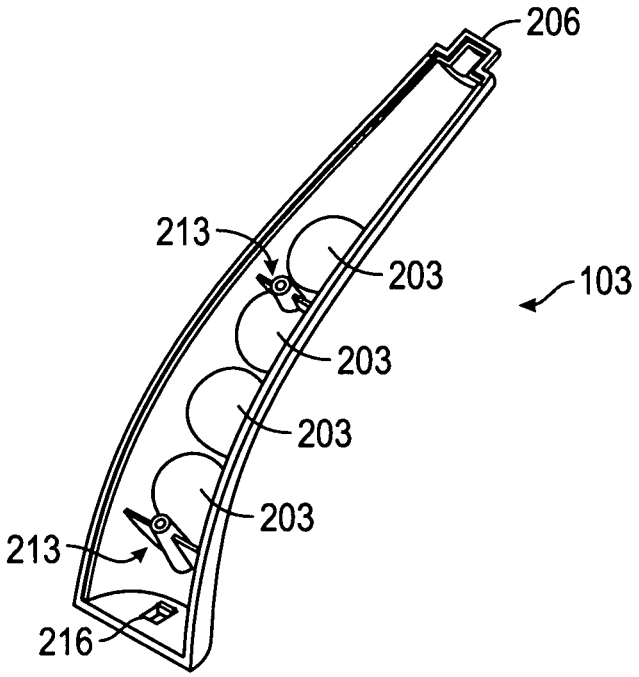
Figure 2C:
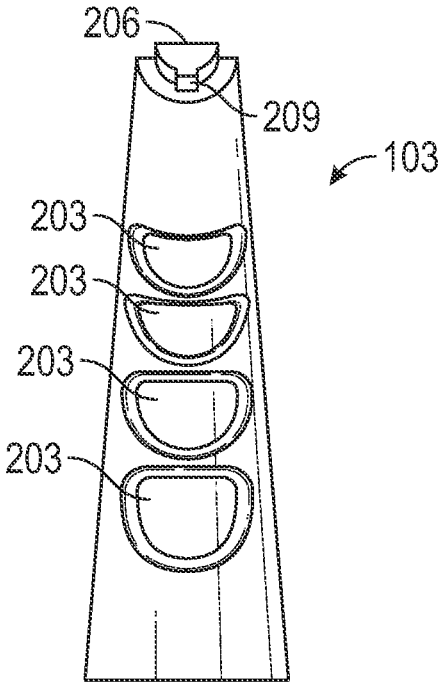

FIGS. 2A-2C depict various perspectives of the first elongated portion 103 of the handle of the apparatus 100 according to various embodiments of the present disclosure. FIG. 2A depicts a side view of the first elongated portion 103 of the handle. FIG. 2B provides an isometric view of the first elongated portion 103 of the handle. FIG. 2C provides a back view of the first elongated portion 103 of the handle.

FIG. 2A depicts a side view of the first elongated portion 103 of the handle of the apparatus 100. One or more indentations 203 in the exterior surface of the first elongated portion 103 can facilitate one or more fingers in gripping the handle of the apparatus 100. The indentations 203 may include depressions in the exterior surface of the first elongated portion 103, grooves that laterally traverse the exterior surface of the first elongated portion 103, or similar changes in the contour of the exterior surface of the first elongated portion 103. Extending from an end of the first elongated portion 103 is a first portion 206 of an attachment point for the sponge cap 116 (FIG. 1). Laterally disposed on an exterior surface of the first portion 206 of the attachment point for the sponge cap 116 is a first ear 209 that allows for the sponge cap 116 to attach to the first elongated portion 103.

FIG. 2B depicts an isometric view of the first elongated portion 103 of the handle of the apparatus 100. The one or more indentations 203 and the first portion 206 of the attachment point for the sponge cap 116 (FIG. 1) are visible. Also visible in the isometric view of FIG. 2B are one or more fasteners 213 and a hole 216 located at the end of the first elongated portion 103 opposite the end including the first portion 206 of the attachment point for the sponge cap 116. The fasteners 213 serve to fasten the first elongated portion 103 of the handle to the second elongated portion 106 of the handle, as further described herein. The hole 216 serves to receive and secure a fastener included on the brush 113, thereby fastening the brush head 113 to the first elongated portion 103 of the handle.

FIG. 2C provides a back view of the first elongated portion 103 of the handle. Visible in FIG. 2C are one or more indentations 203, the first portion 206 of the attachment point for the sponge cap 116, and the first ear 209 laterally disposed on the first portion 206 of the attachment point for the sponge cap 116.

Figure 3A:
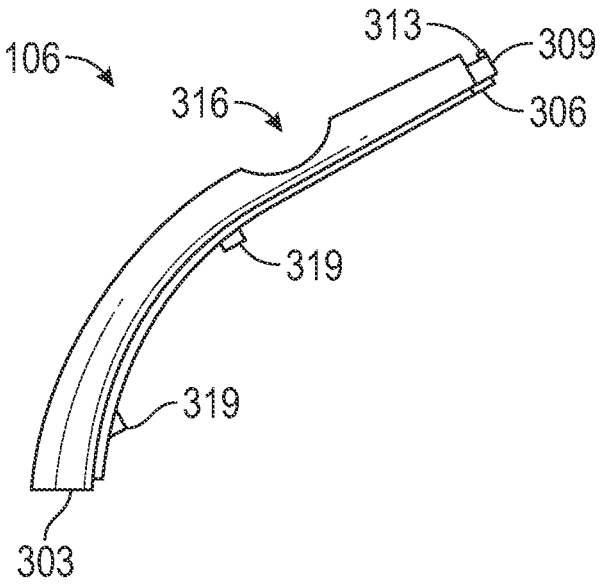
FIGS. 3A-3D are perspective drawings of a component of a nested brush according to various embodiments of the present disclosure.
Figure 3B:
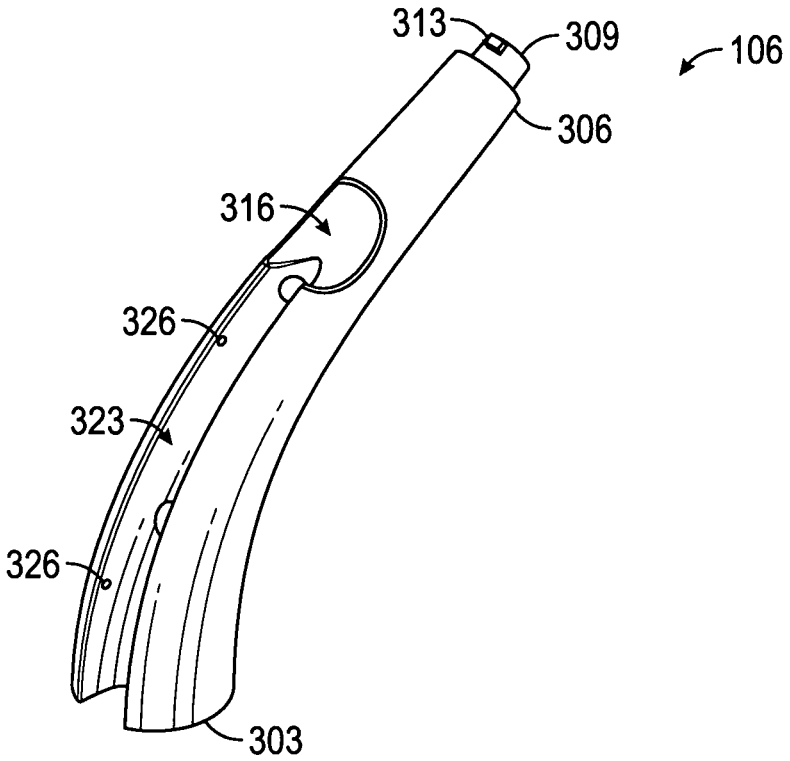
Figure 3C:
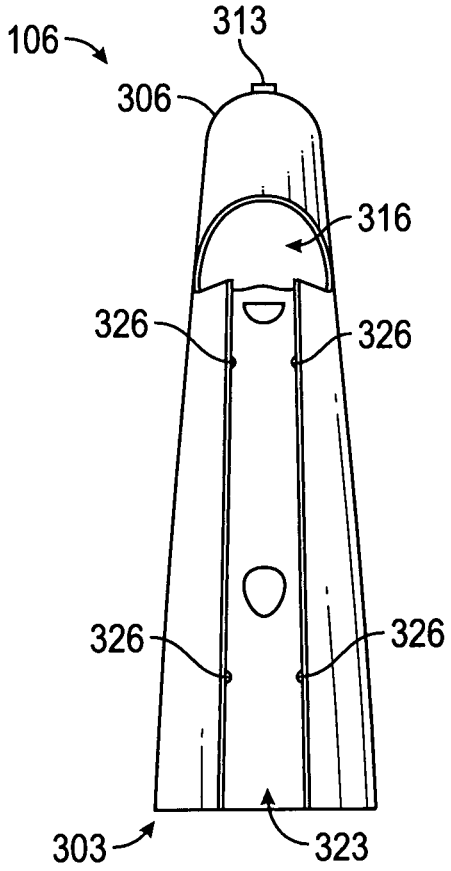
Figure 3D:
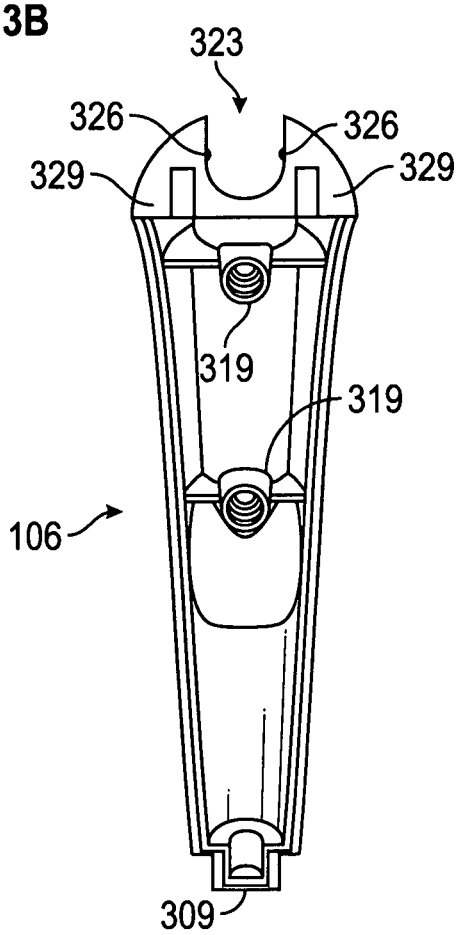

FIGS. 3A-3D depict various perspectives of the second elongated portion 106 of the handle of the apparatus 100 according to various embodiments of the present disclosure. FIG. 3A depicts a side view of the second elongated portion 106 of the handle. FIG. 3B provides an isometric view of the second elongated portion 106 of the handle. FIG. 3C depicts a front view of the second elongated portion 106 of the handle. FIG. 3D depicts rear view of the second elongated portion 106 of the handle.

Visible in the side view of FIG. 3A are a first end 303 of the second elongated portion 106 of the handle, a second end 306 opposite the first end 303, a second portion 309 of the attachment point for the sponge cap 116 (FIG. 1) to the handle, a second ear 313 laterally disposed on an exterior wall of the second portion 309 of the attachment point, at least one indentation 316, and one or more receptacles 319. The second ear 313 allows for the sponge cap 116 to attach to the second elongated portion 106 of the handle of the apparatus 100. The indentation 316 is configured to allow one or more digits of an individual's hand to rest within the indentation 316, improving an individual's grip. Accordingly, the indentation 316 may be of any shape that allows for an individual to rest one or more digits, or portions thereof, within the indentation 316. The receptacles 319 are configured to receive correspondingly positioned fasteners 213 of the first elongated portion 103. When the fasteners 213 are inserted into the receptacles 319, the first elongated portion 103 of the handle becomes connected to the second elongated portion 106 to form a handle for the apparatus 100.

FIG. 3B provides an isometric view of the second elongated portion 106 of the handle. Shown in FIG. 3B are the first end 303, the second end 306, the second portion 309 of the attachment point for the sponge cap 116 (FIG. 1), the second ear 313, and at least one indentation 316. In addition, a brush receptacle 323 extending from the first end 303 along a portion of the length of the second elongated portion 106 is depicted, as are one or more protrusions 326 disposed along an interior wall of the brush receptacle 323. The brush receptacle 323 is configured for a portion of the detail brush 109 to fit within the brush receptacle 323, allowing the detail brush 109 to be nested within the apparatus 100. One or more protrusions 326 are disposed within the brush receptacle 323 to help secure or otherwise fasten or hold the detail brush 109 within the brush receptacle 323, as further described herein.

FIG. 3C depicts a front view of the second elongated portion 106 of the handle. Visible are the first end 303, the second end 306, the second ear 313, at least one indentation 316, the brush receptacle 323, and one or more protrusions 326 disposed within the brush receptacle 323.

FIG. 3D depicts rear view of the second elongated portion 106 of the handle. Visible are the second portion 309 of the attachment point for the sponge cap 116 (FIG. 1), an end portion of the brush receptacle 323, one or more protrusions 326 disposed within the brush receptacle 323, and the receptacle 319. Also visible are one or more holes 329, which allow for the brush head 113 to connect, attach, or otherwise fasten to the second elongated portion 106, as further described herein.

Figure 4A:
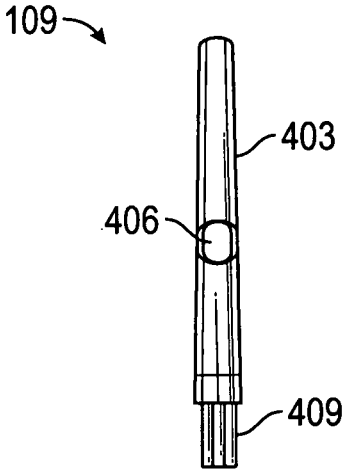
FIGS. 4A-4D are perspective drawings of a component of a nested brush according to various embodiments of the present disclosure.
Figure 4B:
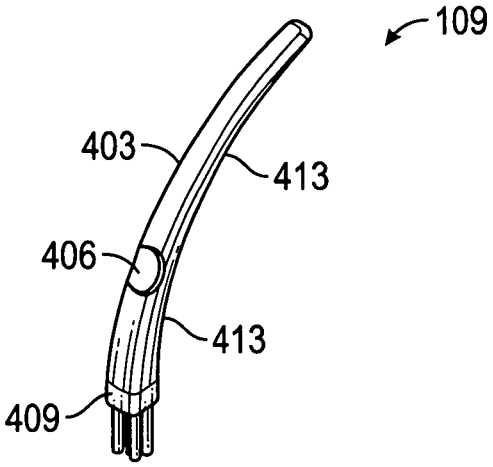
Figure 4C:
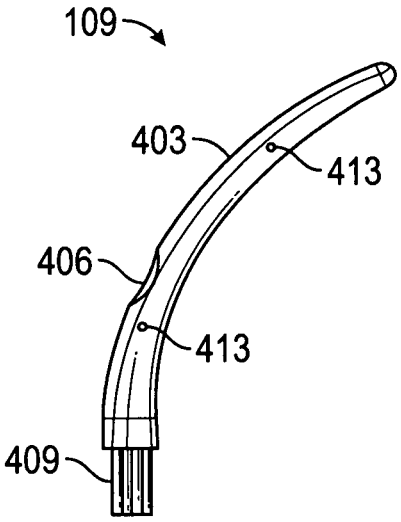
Figure 4D:
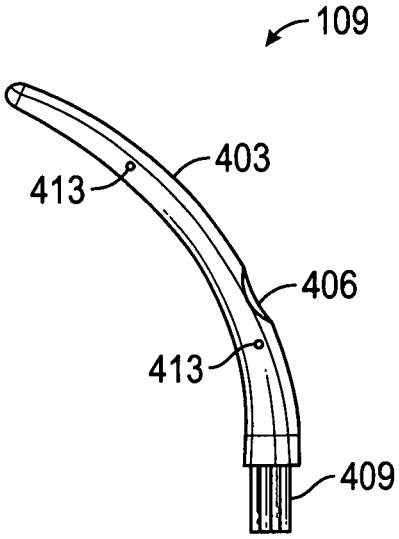

FIGS. 4A-4D depict various perspectives of the detail brush 109 of the apparatus 100 according to various embodiments of the present disclosure. FIG. 4A depicts a front view of the detail brush 109. FIG. 4B provides an isometric view of the detail brush 109. FIG. 4C depicts a view of the detail brush 109 from its left side. FIG. 4D depicts a view of the detail brush 109 from its right side.

FIG. 4A shows the detail brush 109 from a front view. Visible are the handle 403 of the detail brush 109, at least one indentation 406, and a detail brush head 409. The handle 403 allows for an individual to grip the detail brush 109. The at least one indentation 406 is configured to allow for an individual to fit one or more digits within the indentation 406, thereby providing the individual with a more secure grip of the handle 403. The detail brush head 409 is attached or connected to an end of the handle 403 and includes a plurality of bristles extending from the detail brush head 409.

FIG. 4B provides an isometric view of the detail brush 109. Visible are the handle 403, at least one indentation 406, the detail brush head 409, and one or more indentations 413. Each indentation 413 is disposed along the handle 403 to allow for a corresponding protrusion 326 (FIG. 3B and FIG. 3C) of the second elongated portion 106 (FIG. 3B and FIG. 3C) of the handle of the apparatus 100 (FIG. 1) to be inserted into or otherwise engage the indentation 413, thereby fastening or otherwise securing the detail brush 109 to the second elongated portion 106 of the handle of the apparatus 100. In some embodiments, however, the protrusions 326 and indentations 413 may be switched. In these alternative embodiments, the indentations 413 would be disposed within the brush receptacle 323 (FIG. 3B and FIG. 3C) and the protrusions 326 would be disposed in corresponding locations on the handle 403 of the detail brush 109.

FIG. 4C provides a view from the left side of the detail brush 109. Visible are the handle 403, at least one indentation 406, the detail brush head 409, and one or more indentations 413.

FIG. 4D provides a view from the right side of the detail brush 109. Visible are the handle 403, at least one indentation 406, the detail brush head 409, and one or more indentations 413.

Figure 5A:
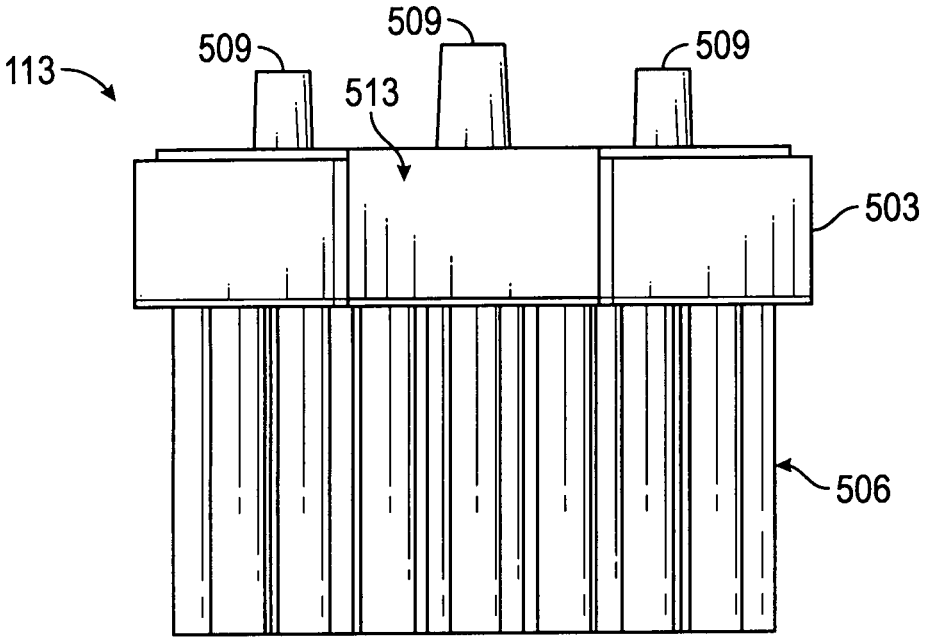
FIGS. 5A-5D are perspective drawings of a component of a nested brush according to various embodiments of the present disclosure.
Figure 5B:
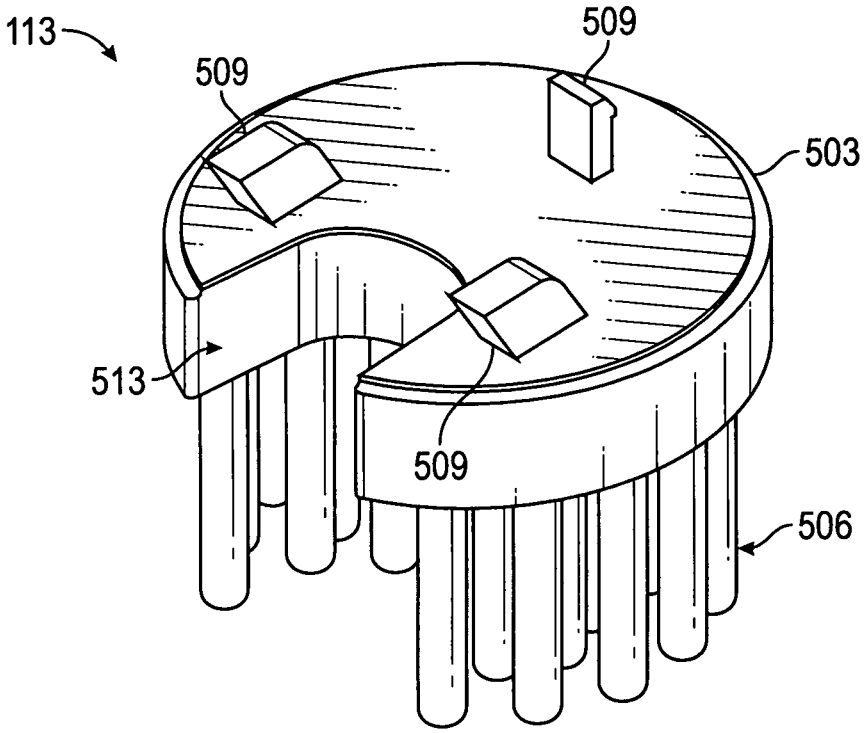
Figure 5C:
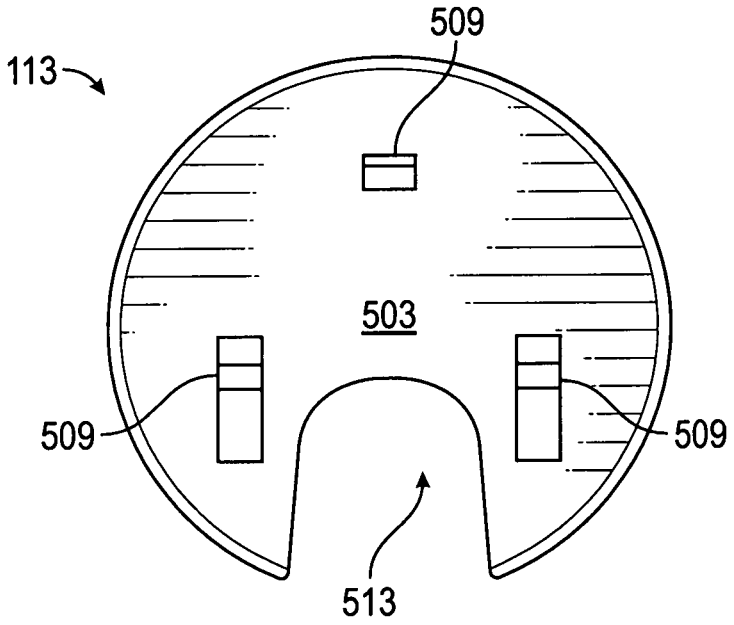
Figure 5D:
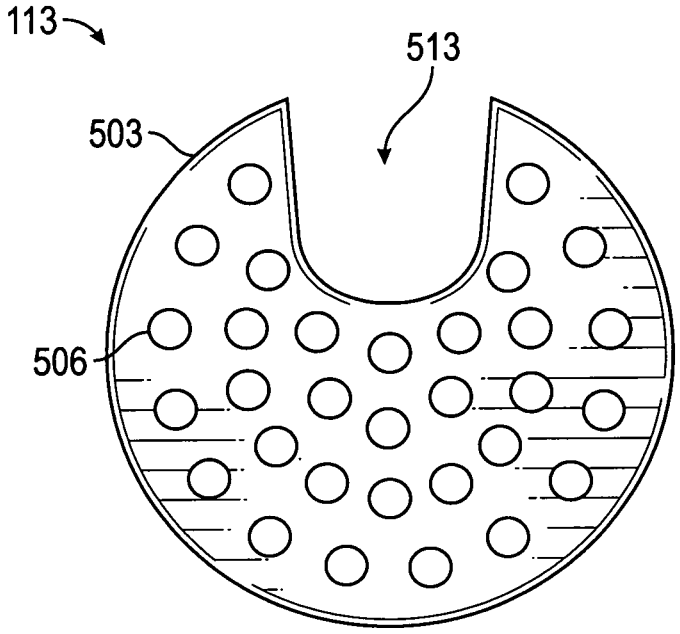

FIGS. 5A-5D depict various perspectives of the brush head 113 of the apparatus 100 according to various embodiments of the present disclosure. FIG. 5A depicts a front view of the brush head 113. FIG. 5B provides an isometric view of the brush head 113. FIG. 5C depicts a top view of the brush head 113. FIG. 5D depicts a bottom view of the brush head 113. In some embodiments, the brush head 113 can be replaceable or interchangeable, so that dirty or worn-out brush heads 113 can be replaced.

Visible in FIG. 5A are a bristle head 503, a plurality of bristles 506, one or more fasteners 509, and a channel or groove 513 in the lateral surface of the bristle head 503. The bristles 506 can be constructed of nylon, polypropylene, polyester, Teflon, abrasive impregnated nylon, conductive nylon, nylon AS, thunderon, natural hair such as horsehair, Tampico, Bassine, stainless steel, steel wire, phosphor bronze, nickel silver, beryllium copper, or similar materials. The fasteners 509 are shaped or configured to be inserted into the or the hole 216 of the first elongated portion 103 (FIG. 2B) or the holes 329 (FIG. 3D) of the second elongated portion 106 of the handle of the apparatus 100 (FIG. 1). For example, the fasteners 509 may include a tab or other protrusion that extends beyond the rim of the hole 329 or hole 216. The fastener 529 may be flexible so that it can be flexed as it is pushed through the hole 329 or hole 216. After being pushed through the hole 329 or hole 216, the fastener 529 will return to its normal position such that the tab or other protrusion overlaps the rim of the hole 329 hole 216, fastening the brush head 113 to the first elongated portion 103 or the second elongated portion 106.

The channel or groove 513 may extend from the top to the bottom of the bristle head 503 along a portion of the lateral surface of the bristle head 503. The channel or groove 513 is configured for the detail brush head 409 to fit within the channel or groove 513.

FIG. 5B provides an isometric view of the brush head 113. Shown are the bristle head 503, a plurality of bristles 506, one or more fasteners 509, and the channel or groove 513.

FIG. 5C provides a top view of the brush head 113, including the bristle head 503, the fasteners 509, and the channel or groove 513.

FIG. 5D provides a bottom view of the brush head 113, including the bristle head 503, the bristles 506, and the channel or groove 513.

Figure 6B:
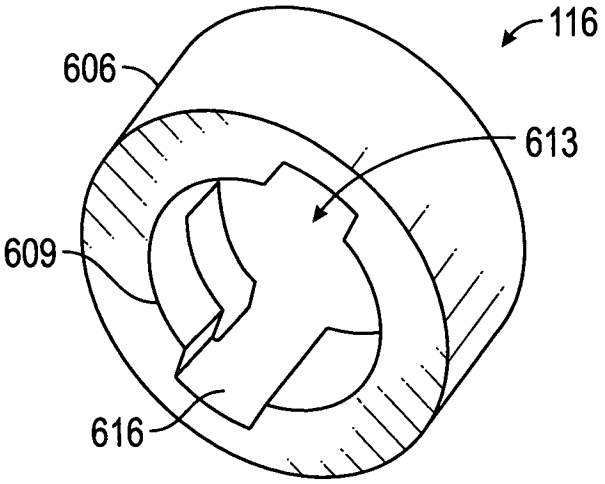
FIGS. 6A-6D are perspective drawings of a component of a nested brush according to various embodiments of the present disclosure.
Figure 6D:
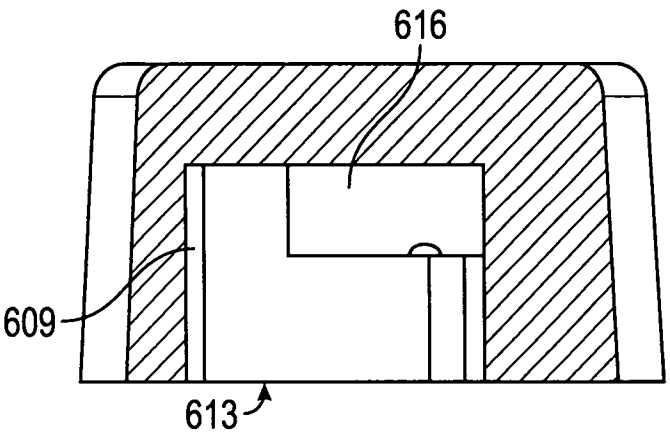
Figure 6A:
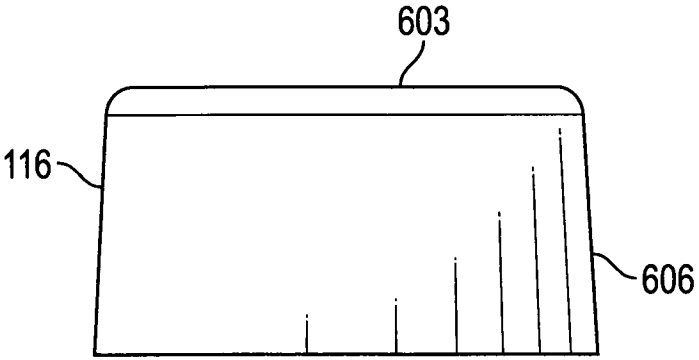
Figure 6C:
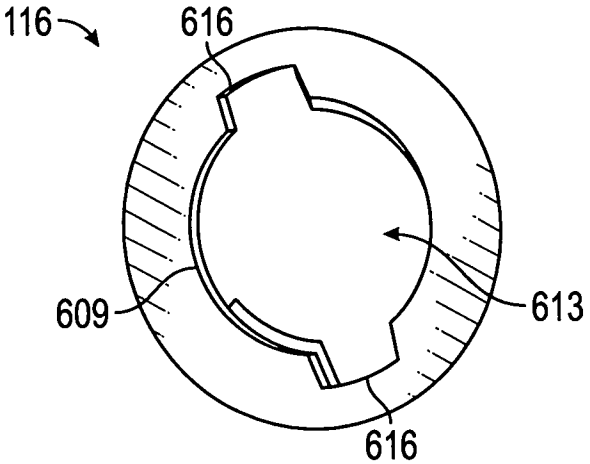

FIGS. 6A-6D depict various perspectives of the sponge cap 116 of the apparatus 100 according to various embodiments of the present disclosure. FIG. 6A depicts a side view of the sponge cap 116. FIG. 6B provides an isometric view of the sponge cap 116. FIG. 6C depicts a bottom view of the sponge cap 116. FIG. 6D depicts a cross-section view of the sponge cap 116.

As illustrated in the side view of the sponge cap 116 of FIG. 6A, the sponge cap 116 includes a solid top surface 603 and an exterior side wall 606. The sponge 119 (FIG. 1) may be attached to the solid top surface 603 using various adhesives. In some embodiments, the sponge 119 may also be attached to the exterior side wall 606 using the adhesive.

FIG. 6B provides an isometric view of the sponge cap 116 from the bottom. Illustrated are the exterior side wall 606, an interior wall 609 forming a cavity 613 within the sponge cap 116, and at least one notch 616 within the interior wall 609. In various embodiments, the groove, track, or thread may be used in place of the notch 616. The notch 616 is configured to receive a corresponding ear 209 (FIG. 2A) of the first elongated portion 103 (FIG. 2A) or a corresponding ear 313 (FIG. 3A) of the second elongated portion 106 (FIG. 3A), thereby attaching or otherwise fastening the sponge cap 116 to the handle formed from fastening the first elongated portion 103 and the second elongated portion 106 together. For example, when the ear 209 or the ear 313 is slid into the notch 616 and the sponge cap 116 is then rotated, the ear 209 or the ear 313 may be placed into position such that the sponge cap 116 is secured to the handle formed from the first elongated portion 103 and the second elongated portion 106.

FIG. 6C illustrates the sponge cap 116 when viewed from the bottom. As shown, the sponge cap 116 includes an interior wall 609 of the cavity 613. One or more notches 616 are disposed along the interior wall 609.

FIG. 6D illustrates a cross-section of the sponge cap 116 when the sponge cap 116 is viewed from the side. The interior wall 609 around the cavity 613 and the cavity 613 itself are depicted. Also shown is the notch 616 as it extends vertically into the cavity 613 from the opening of the cavity 613. Also visible is a secondary portion of the notch 616 that extends laterally from the end of the notch 616 opposite the opening of the cavity 613. When an ear 209 (FIG. 2A) or ear 313 (FIG. 3A) are inserted into the notch, the ear 209 or the ear 313 can then be rotated into the secondary portion of the notch 616, thereby securing or otherwise fastening the sponge cap 116 to the handle formed from the first elongated portion 103 (FIG. 1) and the second elongated portion 106 (FIG. 1).

Figure 7A:
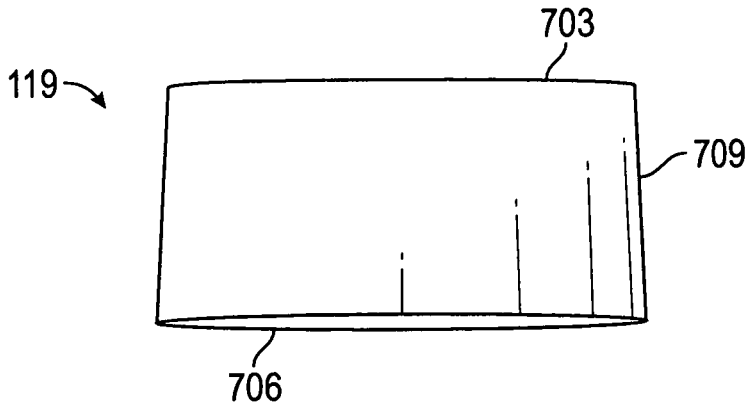
FIGS. 7A-7D are perspective drawings of a component of a nested brush according to various embodiments of the present disclosure.
Figure 7B:
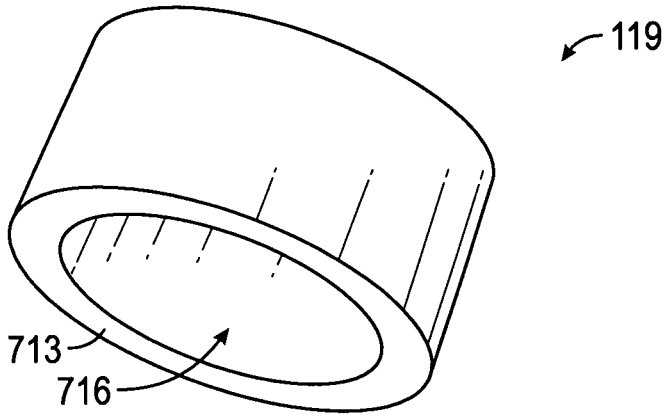
Figure 7C:
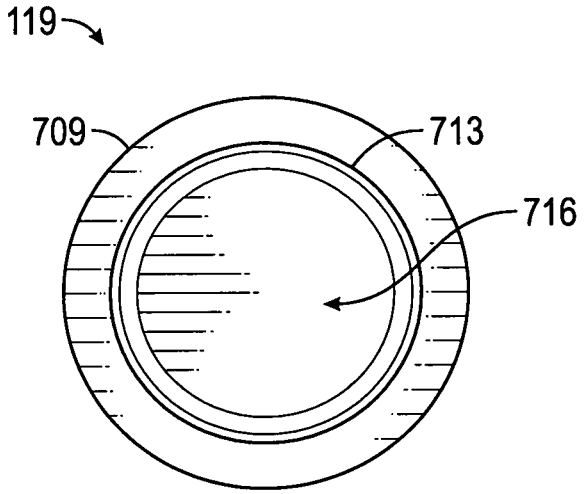
Figure 7D:
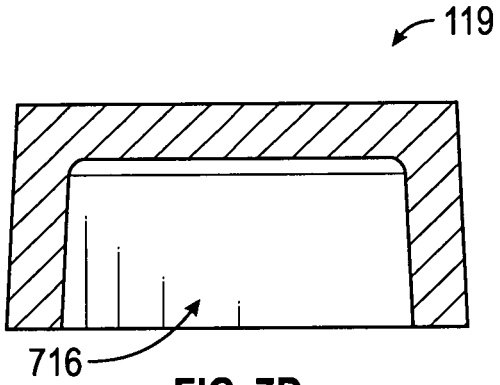

FIGS. 7A-7D depict various perspectives of the sponge 119 of the apparatus 100 according to various embodiments of the present disclosure. FIG. 7A depicts a side view of the sponge 119. FIG. 7B provides an isometric view of the sponge 119. FIG. 7C depicts a bottom view of the sponge 119. FIG. 7D depicts a cross-section view of the sponge 119. The sponge 119 can be constructed from cellular urethane foam, silicone foam, cellular polyurethane, polyester foam, EVA, polyethylene foam, filter foam, or similar materials. The sponge 119 can be a replaceable or interchangeable item, such that the sponge 119 can be replaced as it becomes dirty or worn-out. In such embodiments, the sponge 119 and sponge cap 116 may be replaceable together. For example, in embodiments where the sponge 119 is attached to the sponge cape 116 with an adhesive, the sponge 119 and sponge cape 116 may form a single replaceable or interchangeable unit.

FIG. 7A shows a side view of the sponge 119 according to various embodiments of the present disclosure. As illustrated, the sponge 119 has a top surface 703, a bottom end 706, and an exterior side wall 709. In some embodiments, the exterior wall 709 may taper slightly as it extends from the top surface 703 to the bottom end 706.

FIG. 7B shows an isometric view of the sponge 119 when viewed from underneath. As shown, the sponge 119 has an interior wall 713 surrounding a cavity 716. The cavity 716 may be configured otherwise shaped for at least a portion of the sponge cap 116 (FIG. 1) to be inserted into the cavity 716 of the sponge 119.

FIG. 7C illustrates a view of the sponge 119 when viewed from underneath. Illustrated are the exterior side wall 709 of the sponge 119, the interior wall 713 of the sponge, and the cavity 716 formed by the interior wall 713 of the sponge 119.

FIG. 7D provides a cross-section of the sponge 119 in which cavity 716 is visible.

Figure 8A:
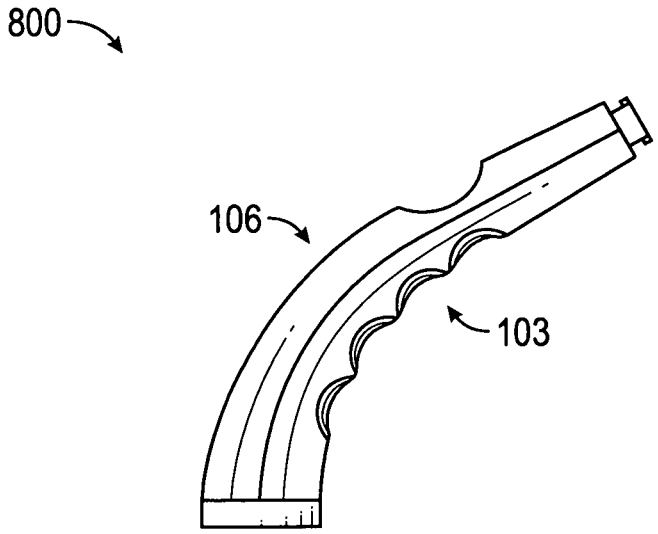
FIGS. 8A-8D illustrate an assembly of several components of a nested brush according to various embodiments of the present disclosure.
Figure 8B:
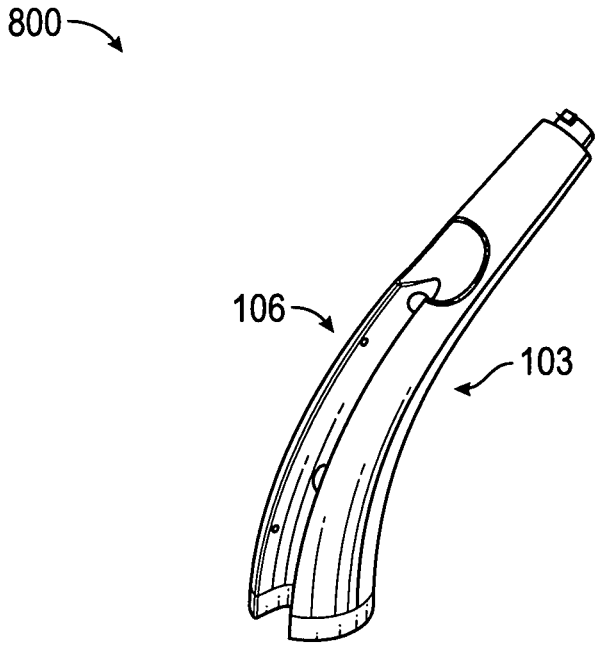
Figure 8C:
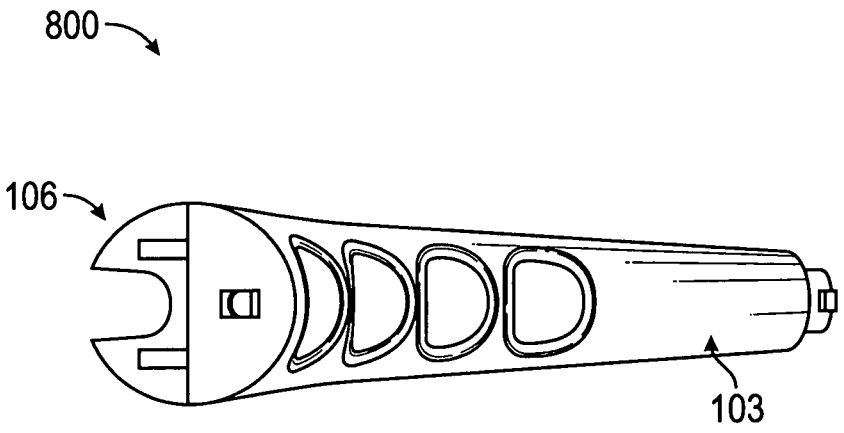
Figure 8D:
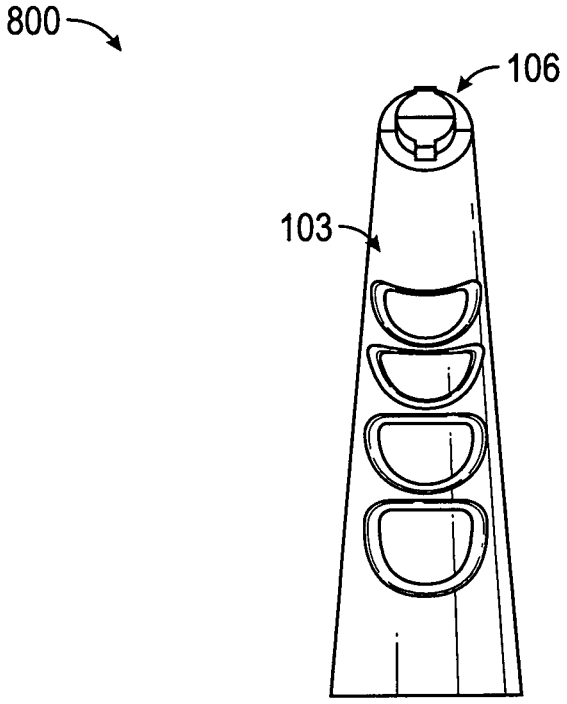

FIGS. 8A-8D depict various perspectives of the first elongated portion 103 connected to the second elongated portion 106 of the apparatus 100 (FIG. 1) to create the handle 800 of the apparatus 100 according to various embodiments of the present disclosure, as previously described. FIG. 8A depicts a side view of the handle 800 formed by the first elongated portion 103 and the second elongated portion 106. FIG. 8B provides an isometric view of the handle 800 formed by the first elongated portion 103 and the second elongated portion 106. FIG. 8C depicts a bottom view of the handle 800 formed by the first elongated portion 103 and the second elongated portion 106. FIG. 8D depicts a rear view of the handle 800 formed by the first elongated portion 103 and the second elongated portion 106.

Figure 9A:
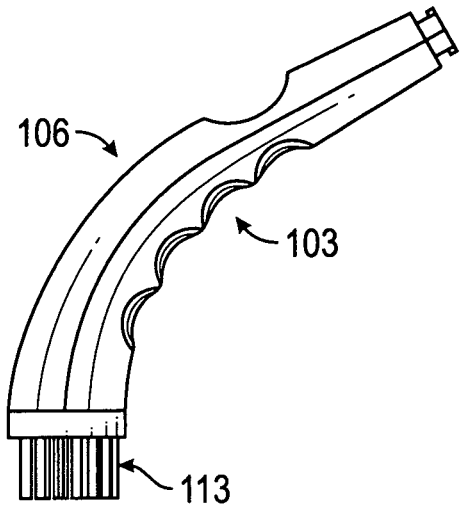
FIGS. 9A-9D illustrate an assembly of several components of a nested brush according to various embodiments of the present disclosure.
Figure 9B:
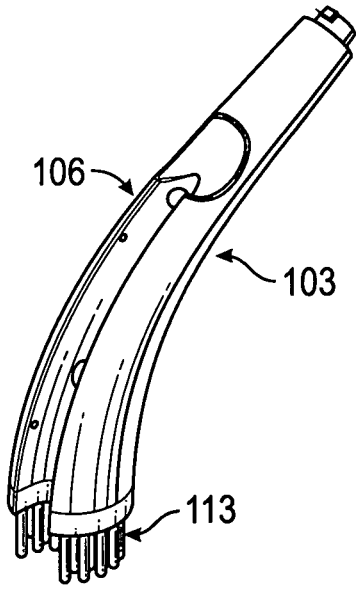
Figure 9C:
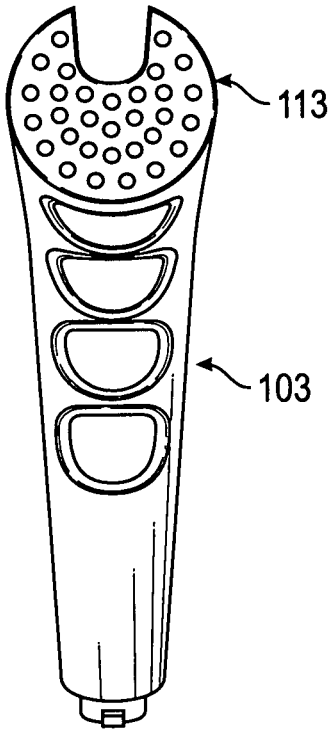
Figure 9D:
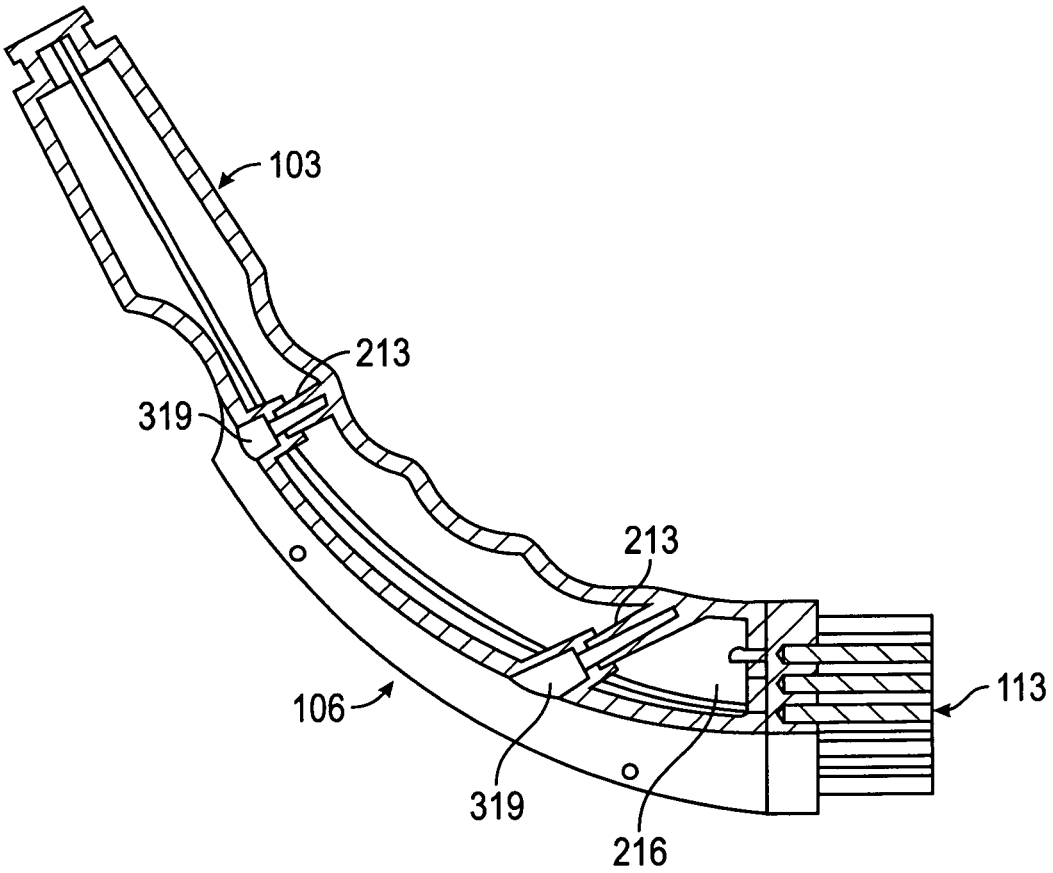

FIGS. 9A-9D depict various perspectives of the first elongated portion 103, the second elongated portion 106, and the brush head 113 assembled together according to various embodiments of the present disclosure. FIG. 9A depicts a side view of the assembled first elongated portion 103, second elongated portion 106, and brush head 113. FIG. 9B provides an isometric view of the assembled first elongated portion 103, second elongated portion 106, and brush head 113. FIG. 9C depicts a bottom view of the assembled first elongated portion 103, second elongated portion 106, and brush head 113. FIG. 9D depicts a cross-section of the assembled first elongated portion 103, second elongated portion 106, and brush head 113.

In the cross-section depicted in FIG. 9D, the interactions between the fasteners 213, the receptacles 319, the hole 216, and the fasteners 509 are depicted. As shown, the fasteners 213 are inserted into the receptacles 319, fastening the first elongated portion 103 of the handle 800 (FIG. 8A) to the second elongated portion 106 of the handle 800. A fastener 509 is also inserted into the hole 216, fastening the brush head 113 to the first elongated portion 103 of the handle 800.

Figure 10A:
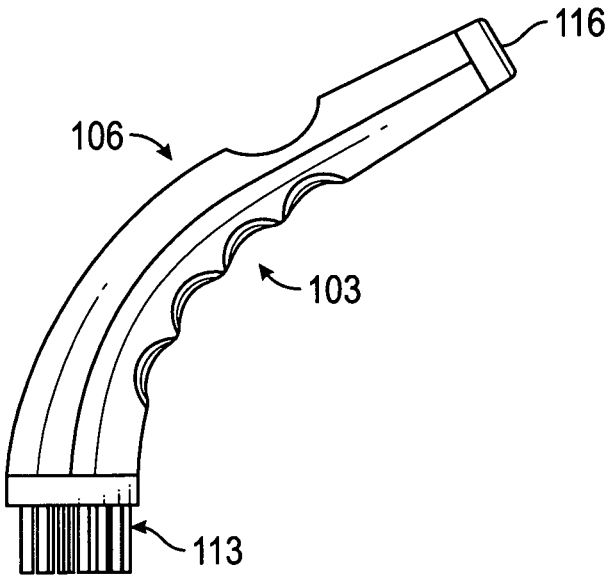
FIGS. 10A-10D illustrate an assembly of several components of a nested brush according to various embodiments of the present disclosure.
Figure 10B:
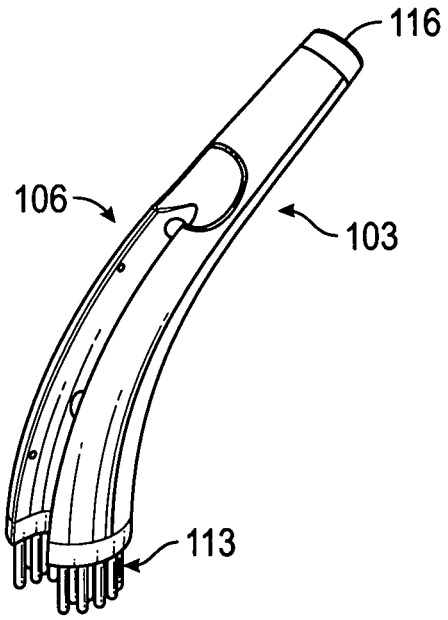
Figure 10C:
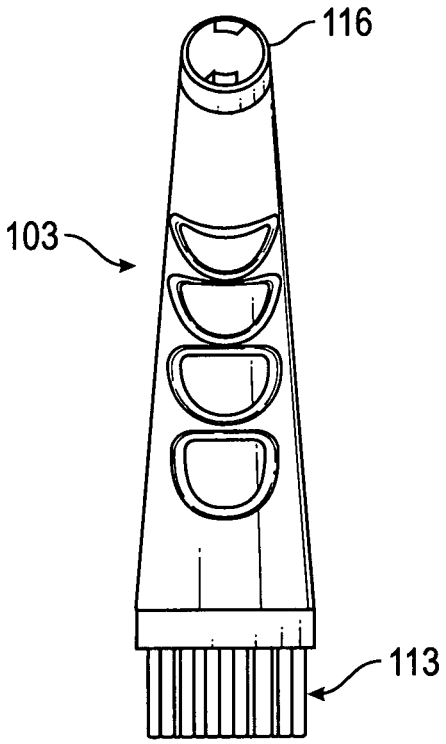
Figure 10D:
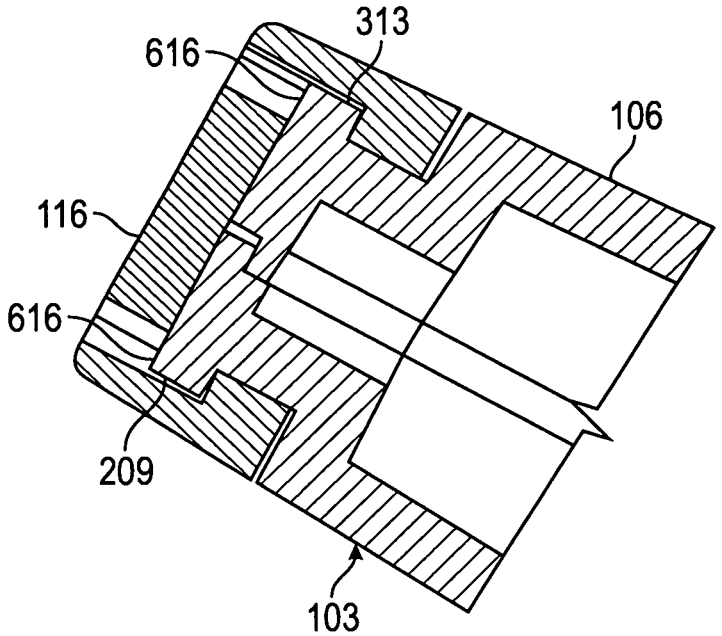

FIGS. 10A-10D depict various perspectives of the first elongated portion 103, the second elongated portion 106, the brush head 113, and the sponge cap 116 assembled together according to various embodiments of the present disclosure. FIG. 10A depicts a side view of the assembled the first elongated portion 103, the second elongated portion 106, the brush head 113, and sponge cap 116. FIG. 10B provides an isometric view of the assembled the first elongated portion 103, the second elongated portion 106, the brush head 113, and sponge cap 116. FIG. 10C depicts a rear view of the assembled the first elongated portion 103, the second elongated portion 106, the brush head 113, and sponge cap 116. FIG. 10D depicts a cross-section of the assembled the first elongated portion 103, the second elongated portion 106, the brush head 113, and sponge cap 116.

In the cross-section depicted in FIG. 10D, an approach for fastening the sponge cap 116 to the first elongated portion 103 and the second elongated portion 106 is further illustrated. The position of the ear 209 of the first elongated portion 103 within a first notch 616 of the sponge cap 116 is illustrated. Also shown is the position of the ear 313 of the second elongated portion 106 within a second notch 616 of the sponge cap 116. Due to the position of the ear 209 in the first notch 616 and the position of the ear 313 in the second notch 616, the sponge cap 116 remains fastened to the first elongated portion 103 and the second elongated portion 106 of the handle 800 (FIG. 8A).

Figure 11A:
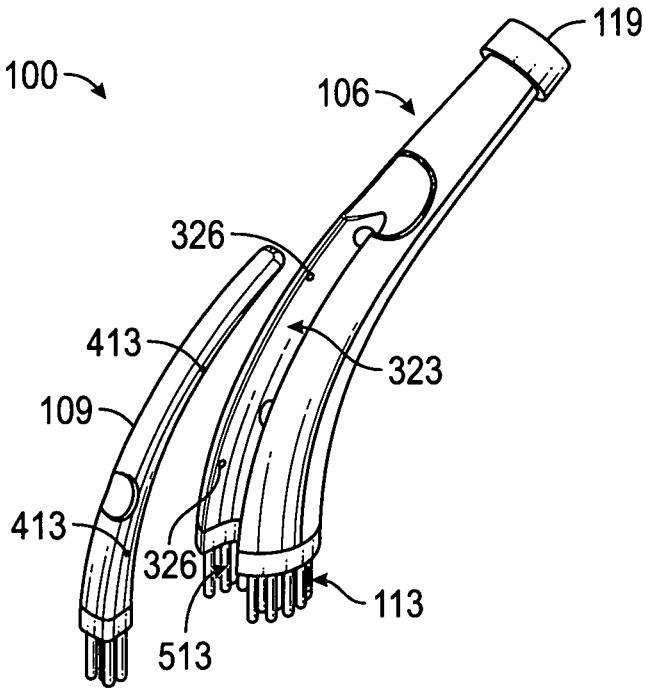
FIGS. 11A and 11B illustrate an assembly of several components of a nested brush according to various embodiments of the present disclosure.
Figure 11B:
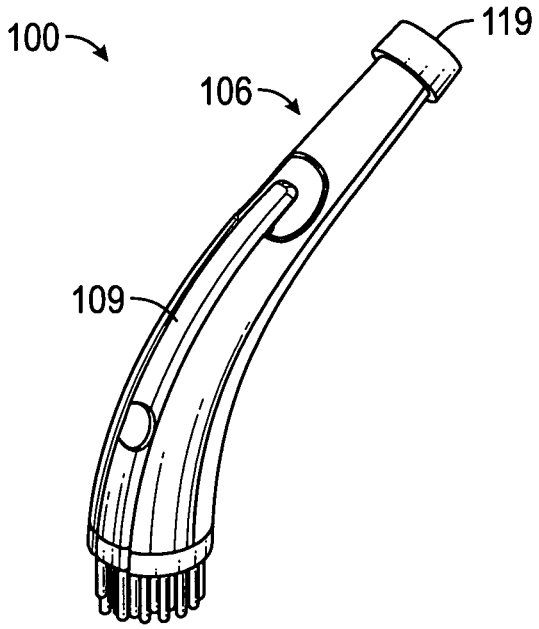

FIGS. 11A and 11B depict a fully assembled embodiment of the apparatus 100 according to various embodiments of the present disclosure. FIG. 11A shows the fully assembled embodiment with the detail brush 109 detached. FIG. 11B shows the fully assembled embodiment of the apparatus 100 with the detail brush 109 attached.

As illustrated in FIG. 11A, the detached detail brush 109 can fit within the brush receptacle 323 of the second elongated portion 106 and the groove 513 of the brush head 113. To fasten the detail brush 109 to the apparatus 100, the detail brush 109 can be placed within the brush receptacle 323 and groove 513. As the detail brush 109 is placed into the brush receptacle 323 and the groove 513, the protrusions 326 will insert or snap into the correspondingly positioned indentations 413 along the handle 403 (FIG. 4A) of the detail brush 109.

As illustrated in FIG. 11B, the detail brush 109 is inserted into the brush receptacle 323 (FIG. 11) and groove 513 (FIG. 11A). The bristles 409 of the detail brush 109 are positioned such that the ends of the bristles 506 (FIG. 5A and FIG. 5B) of the brush head 113 (FIG. 11A) lie on the same plane as the ends of the bristles 409 of the detail brush 109, allowing for the bristles 409 of the detail brush 109 to be used in conjunction with the bristles 506 of the brush head 113 when the detail brush 109 is fastened to the second elongated portion 106 of the apparatus 100.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An apparatus, comprising:

a first brush, comprising:

a first elongated handle comprising a first end, a second end, and a brush receptacle extending from the first end of the first elongated handle along a portion of the first elongated handle; and a first brush head detachably attached to the first end of the first elongated handle through one or more fasteners protruding out of a surface of the first brush head, the one or more fasteners configured to be inserted into one or more holes located on the first end of the first elongated handle, the first brush head comprising a bristle head and a first plurality of bristles, the bristle head comprising:

a first end surface, a second end surface, and a groove extending from the first end surface through the first plurality of bristles, the groove being positioned to match an opening of the brush receptacle at the first end of the first elongated handle, the first plurality of bristles attached to the second end surface of the bristle head; and a second brush, comprising:

a second elongated handle comprising a first end and a second end, the second elongated handle being configured to fit within the brush receptacle of the first elongated handle and the groove of the bristle head; and a second brush head attached to the first end of the second elongated handle, the second brush head comprising a second plurality of bristles, wherein, when the second brush is inserted into the brush receptacle and the groove, the second plurality of bristles are positioned such that ends of the first plurality of bristles lie on a same plane as ends of the second plurality of bristles allowing for the second plurality of bristles to be used in conjunction with the first plurality of bristles when the second brush is fastened to the first elongated handle.

2. The apparatus of claim 1, wherein the first elongated handle comprises at least one indentation on an exterior surface of the first elongated handle.

3. The apparatus of claim 1, wherein the brush receptacle comprises at least one protrusion located within the groove and the second brush comprises at least one indentation at a corresponding location on an external surface of the second brush.

4. The apparatus of claim 1, further comprising:

a sponge cap attached to the second end of the first elongated handle; and a sponge attached to the sponge cap.

5. The apparatus of claim 4, wherein the sponge is detachably attached to the sponge cap.

6. The apparatus of claim 4, wherein the groove is a first groove and the second end of the first elongated handle comprises a cylindrically shaped protrusion comprising an ear extending from a side of the cylindrically shaped protrusion, and the sponge cap comprises a second groove along an interior surface of the sponge cap and the ear is configured to fit within the second groove to attach the sponge cap to the second end of the first elongated handle.

7. The apparatus of claim 1, wherein the first elongated handle further comprises an indentation on an external surface of the first elongated handle.

8. The apparatus of claim 1, wherein the second elongated handle further comprises an indentation on an external surface of the second elongated handle.

9. The apparatus of claim 1, wherein the first elongated handle comprises a first elongated portion fastened to a second elongated portion.

10. A nested brush, comprising:

a first brush, comprising:

a first elongated handle comprising a first end, a second end, and a brush receptacle extending from the first end of the first elongated handle along a portion of the first elongated handle; and a first brush head detachably attached to the first end of the first elongated handle, the first brush head comprising a bristle head and a first plurality of bristles, the bristle head comprising:

a first end surface, a second end surface, and a groove extending from the first end surface through the first plurality of bristles, the groove being positioned to match an opening of the brush receptacle at the first end of the first elongated handle, the first plurality of bristles attached to the second end surface of the bristle head; and a second brush, comprising:

a second elongated handle comprising a first end and a second end, the second elongated handle being configured to fit within the brush receptacle of the first elongated handle; and a second brush head attached to the first end of the second elongated handle, wherein, when the second brush is inserted into the brush receptacle and the groove, a second plurality of bristles of the second brush head are positioned such that ends of the first plurality of bristles lie on a same plane as ends of the second plurality of bristles allowing for the second plurality of bristles to be used in conjunction with the first plurality of bristles when the second brush is fastened to the first elongated handle.

11. The nested brush of claim 10, wherein the brush receptacle comprises at least one protrusion located within the groove and the second brush comprises at least one indentation at a corresponding location on an external surface of the second brush.

12. The nested brush of claim 10, further comprising a cap affixed to the second end of the first elongated handle.

13. The nested brush of claim 12, wherein the groove is a first groove and the second end of the first elongated handle comprises a cylindrically shaped protrusion comprising an ear extending from a side of the cylindrically shaped protrusion, and the cap comprises a second groove along an interior surface of the cap and the ear is configured to fit within the second groove to attach the cap to the second end of the first elongated handle.

14. The nested brush of claim 12, further comprising a sponge attached to the cap.

15. The nested brush of claim 10, wherein the first elongated handle further comprises an indentation on an exterior surface of the first elongated handle.

16. The nested brush of claim 15, wherein the first elongated handle comprises a first elongated portion fastened to a second elongated portion, the exterior surface of the first elongated handle is a first exterior surface of the first elongated portion, the indentation is a first indentation on the first exterior surface of the first elongated portion, and the nested brush further comprises a second indentation located on a second exterior surface of the second elongated portion.

17. The nested brush of claim 10, wherein the second elongated handle further comprises an indentation on an exterior surface of the second elongated handle.

18. A device, comprising:

a first brush, comprising:

a first elongated handle comprising:

a first end;

a second end comprising a cylindrically shaped protrusion comprising an ear extending from a side of the cylindrically shaped protrusion; and a brush receptacle extending from the first end of the first elongated handle along a portion of the first elongated handle; and a first brush head detachably attached to the first end of the first elongated handle through one or more fasteners protruding out of a surface of the first brush head, the one or more fasteners configured to be inserted into one or more holes located on the first end of the first elongated handle, the first brush head comprising a bristle head and a first plurality of bristles, the bristle head comprising:

a first end surface, a second end surface, and a first groove extending from the first end surface through the first plurality of bristles, the first groove being positioned to match an opening of the brush receptacle at the first end of the first elongated handle, and the first plurality of bristles being attached to the second end surface of the bristle head; and a second brush, comprising:

a second elongated handle comprising a first end and a second end, the second elongated handle being configured to fit within the brush receptacle of the first elongated handle and the groove of the bristle head; and a second brush head attached to the first end of the second elongated handle, the second brush head comprising a second plurality of bristles, wherein, when the second brush is inserted into the brush receptacle and the first groove, the second plurality of bristles are positioned such that ends of the first plurality of bristles lie on a same plane as ends of the second plurality of bristles allowing for the second plurality of bristles to be used in conjunction with the first plurality of bristles when the second brush is fastened to the first elongated handle.

* * * * *